US005138302A

United States Patent [19]

Nagaoka et al.

[11] Patent Number: 5,138,302

[45] Date of Patent: Aug. 11, 1992

[54] PHOTOELECTRIC, SCATTERED LIGHT SMOKE DETECTOR

[75] Inventors: Akira Nagaoka; Shigeki Shimomura; Masao Arakawa; Tomizo Terasawa; Hironori Kami; Masanobu Ogawa, all of Kadoma, Japan

[73] Assignee: Matsushita Electric Works, Ltd., Osaka, Japan

[21] Appl. No.: 578,598

[22] Filed: Sep. 7, 1990

[30] Foreign Application Priority Data

Sep. 26, 1989 [JP] Japan ..... 1-250106

[51] Int. Cl.[5] ..... G08B 17/10

[52] U.S. Cl. ..... 340/630; 250/574; 340/628

[58] Field of Search ..... 340/630, 628; 250/574–576; 356/438, 439

[56] References Cited

U.S. PATENT DOCUMENTS 2,580,500 1/1952 Albert ..... 250/574
4,584,485 4/1986 Powers et al. ..... 250/574
4,897,634 1/1990 Sawa et al. ..... 340/630

FOREIGN PATENT DOCUMENTS 63-34520 11/1988 Japan .

*Primary Examiner*—Edward L. Coles, Sr.
*Assistant Examiner*—Jill Jackson
*Attorney, Agent, or Firm*—Burns, Doane, Swecker & Mathis

[57] ABSTRACT

A photoelectric smoke detector has a circuit substrate coupled to an optical-system base as disposed in a circuit accommodating zone defined within a detector housing by the base together with a smoke supervisory zone, a light projecting element and an integrated circuit incorporating therein a light receiving element and smoke detecting means are mounted to the circuit substrate, and the optical-system base holds therein a light receiving lens which is capable of condensing scattered light from smoke particles onto the light receiving element in the integrated circuit on the circuit substrate. Effective reduction in the number of constituent parts is thereby attained, to promote reduction in manufacturing costs, and to effectively realize dimensional minimization.

2 Claims, 2 Drawing Sheets

PHOTOELECTRIC, SCATTERED LIGHT SMOKE DETECTOR

BACKGROUND OF THE INVENTION

This invention relates to photoelectric smoke detectors and, more particularly, to a detector which senses the presence of smoke with a detection by a light receiving element of scattered light due to smoke particles present in a smoke supervisory zone defined in the detector, the light being projected from a light projecting element to the smoke supervisory zone.

The photoelectric smoke detector of the kind referred to can effectively contribute to highly precise fire alarming such as employed concurrently with a heat detector and the like devices.

DESCRIPTION OF RELATED ART

The photoelectric smoke detector of the type referred to in the above is so arranged, as has been disclosed in, for example, Japanese Patent Publication No. 63-34520, that the interior of a detector housing is separated by an optical system base into two upper and lower chambers, the lower chamber is employed as a smoke supervisory zone in which a light projecting element and a light receiving element are disposed, and the upper chamber is used as a circuit housing zone in which a circuit substrate is provided, onto which circuit substrate a driving circuit for the light projecting element as well as a circuit for detecting the presence of smoke in the smoke supervisory zone on the basis of an output of the light receiving element are mounted. These light projecting and receiving elements are disposed to cause their optical axes substantially intersect each other, and a partition means is provided for preventing the light of the light projecting element from being directly incident on the light receiving element. Further, as the output of the light receiving element is a faint signal which is likely to be influenced by any external noise, a measure is taken for shielding the element by means of a shield plate surrounding both side surfaces and all peripheral sides of the circuit substrate.

In the photoelectric smoke detector of the foregoing arrangement, a beam of light from the light projecting element is caused to be scattered by smoke particles once smoke intrudes through smoke inlet holes into the smoke supervisory zone, and to be partly received by the light receiving element, and the presence of smoke is thereby sensed.

In this arrangement, however, the light receiving element is of a lead-type which is considerably large in size and requires lead wires for its connection with the smoke detecting circuit to be longer. The required provision of the shield plate for preventing any malfunction due to the external noise or the like has been a problem with increments in the number of required of constituent parts, these rendering manufacturing costs to be high and intended size minimization to be difficult.

SUMMARY OF THE INVENTION

A primary object of the present invention therefore, to provide a photoelectric smoke detector which has eliminated the foregoing problems, and is capable of effectively reducing the number of required parts to render manufacturing costs to be lower, restricting any influence of the external noise and being contributive sufficiently to the dimensional minimization.

According to the present invention, this object can be attained by means of a photoelectric smoke detector in which a smoke supervisory zone and a circuit accommodating zone are defined within a housing with an optical-system base interposed. A beam of light from a light projecting element and scattered by smoke particles in the smoke supervisory zone is detected by a light receiving element, and the presence of smoke is sensed through a smoke detecting means mounted to a circuit substrate disposed in the circuit accommodating zone. The present invention is characterized in that the circuit substrate to which a smoke detecting means, light projecting element and light receiving element are mounted is coupled to the optical-system base, and a light receiving lens means in which a prism section having a light reflection plane which alters advancing direction of the scattered light from the smoke supervisory zone and a lens section which condenses the light of altered advancing direction from the prism section onto the light receiving element on the circuit substrate are integrally formed and held by the optical-system base.

Other objects and advantages of the present invention should become clear as following description of the invention detailed with reference to an embodiment shown in accompanying drawings advances.

While the present invention shall now be described with reference to the embodiment shown, it should be appreciated that the intention is not to limit the invention only to the particular embodiment but rather to include all alterations, modifications and equivalent arrangements possible within the scope of appended claims.

DETAILED DESCRIPTION OF THE PREFERRED EMBODIMENT

Figure 1:
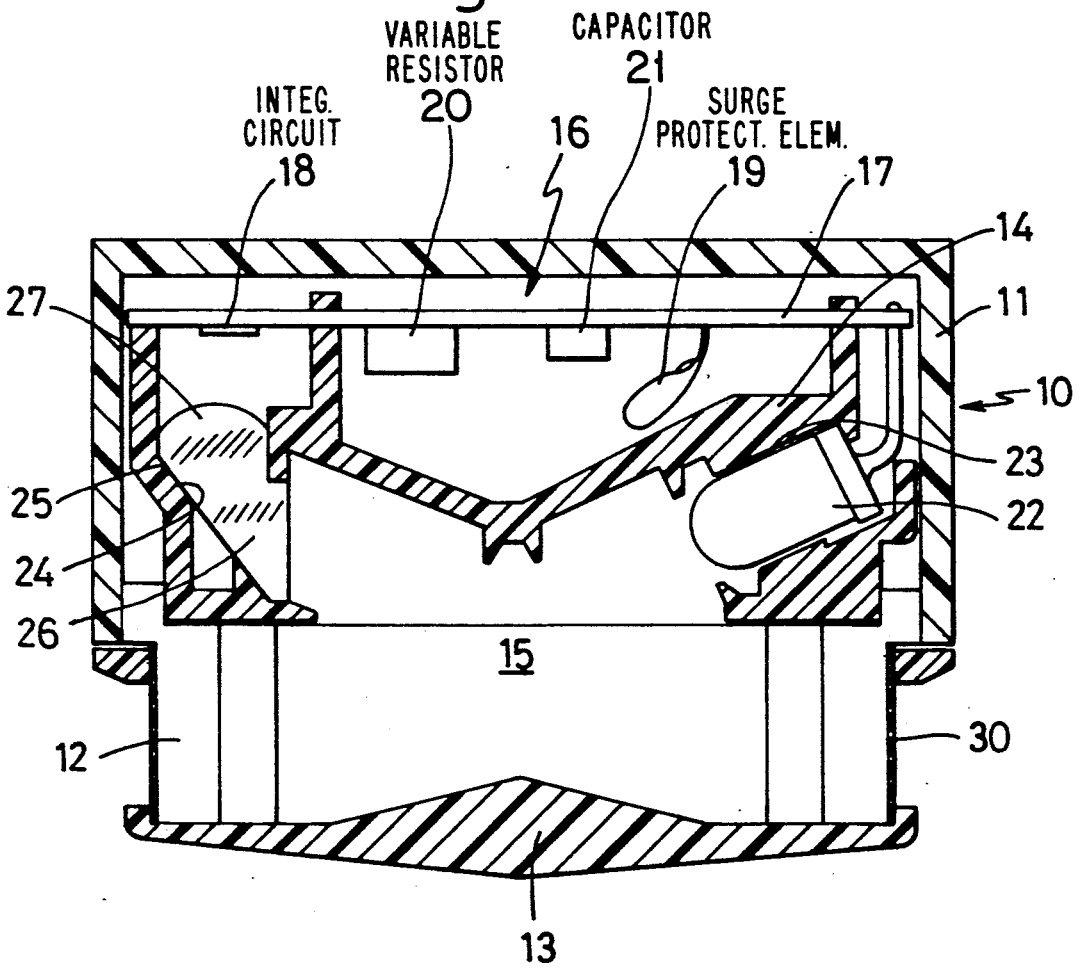
FIG. 1 is a sectioned view in an embodiment of the photoelectric smoke detector according to the present invention.
Figure 2:
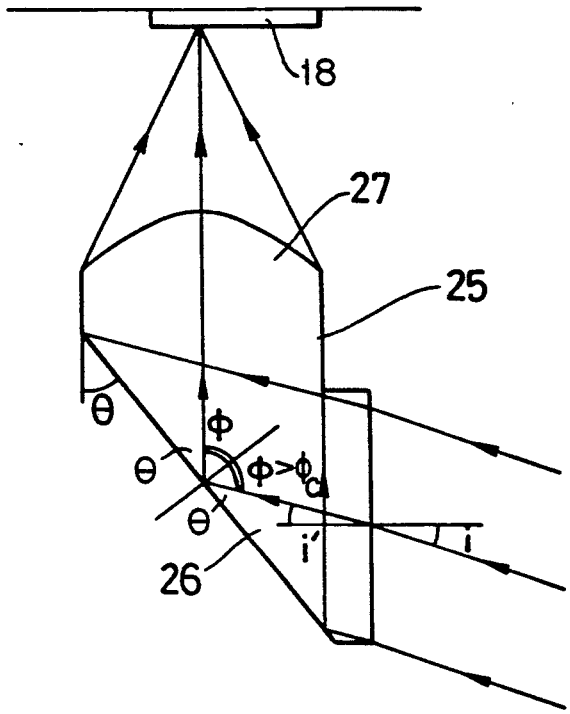
FIG. 2 is an explanatory view for the light receiving lens means in the smoke detector of FIG. 1.

Referring here to FIGS. 1 and 2, the photoelectric smoke detector of the present invention generally comprises a housing 10 including a cylindrical body 11 closed at top end, a substantially cylindrical labyrinth member 12 mounted to bottom open end of the body 11, and a bottom cover 13 fitted to cover the open end, that is, the bottom side of the labyrinth member 12. Inside the cylindrical body 11, an optical-system base 14 is provided so that there will be defined in the housing and below the base 14 a smoke supervisory zone 15 and above the base 14 a circuit accommodating zone 16, in the latter of which a circuit substrate 17 is accommodated and coupled to the base 14 by means of a fitting engagement or the like.

To the circuit substrate 17, there is mounted an integrated circuit 18 into which all necessary elements are incorporated except a surge protection element 19, variable resistor 20 for adjusting the sensitivity and capacitor 21 which are difficult or undesirable to incorporate on the integrated circuit 18. More specifically, the light receiving element formed by photodiode or the like, a smoke detecting circuit which senses the presence of smoke in accordance with an output of the light receiving element, a driving circuit for the light projecting element and a power source circuit can be incorporated into the integrated circuit 18. Additionally, the smoke detecting circuit comprises an analogue signal processing circuit for processing the output of the light receiving element, a digital circuit for controlling a switching circuit on the basis of an output of the signal processing circuit, and so on. In forming the integrated circuit 18, it will be possible to employ such a method as disclosed in U.S. patent application No. 07/423,235 of M. Arakawa et al (or corresponding British patent application No. 22 25 108 A, or Swedish patent application No. 89 03 487.0), assigned to the same assignee as that of the present invention. The circuit substrate 17 further carries a light projecting element 22 mounted at its terminals to the substrate, together with the foregoing integrated circuit 18 and other elements 19–21. The light projecting element 22 itself is seated in a hole 23 formed in the optical-system base 14 for holding the element 22 at a position of facing the smoke supervisory zone 15. The optical-system base 14 is further provided with a lens supporting hole 24, in which a light receiving lens 25 for condensing scattered light due to smoke particles upon the light receiving element incorporated in the integrated circuit 18 is disposed, and the light projecting element 22 and light receiving lens 25 are so positioned as to oppose each other but with their optical axes made to intersect each other.

As will be clear when FIG. 2 is referred to, this light receiving lens 25 comprises prism section 26 on which the scattered light occurring due to the smoke particles present in the smoke supervisory zone 15 is made incident and having a reflection plane which alters advancing direction of the scattered light received, and a lens section 27 continuous to the prism section 26 for condensing the light of the altered advancing direction upon the light receiving element on the circuit substrate 17. It is preferable in this case that the light receiving lens 25 is formed into an integral body with such transparent material as acrylic resin or polycarbonate, and that the prism section 26 is so provided as to utilize the total reflection. Here, the light projecting element 22 employed is normally about 600-1,000 nm in the output wavelength, and the light receiving lens 25 of such transparent material as above should be about 1.48 to 1.59 in the refractive index $n$ at the prism section 26. Between the incident angle $i$ outside the incident plane and the refractive angle $i'$inside the incident plane of the scattered light at the prism section 26, in general, there is established a following formula:

$$i' = \sin^{-1}\{(\sin i)/n\}$$

If it is assumed that $i = 20°$, the refractive angle at incident plane of the prism section 26 will be $i' \approx 12.4°$ to 13.4°. On the other hand, the critical angle (determined by the index of refraction being larger than that of air) will be $\phi c = \sin^{-1}(1/n)$, so that $\phi c \approx 39.0$ to 42.5°. Provided that $2\theta + 1' = 90°$is set in FIG. 2, for example, it becomes that $\theta \approx 38.3$ to 38.8°so that $\theta + \phi = 90°$, and $\phi = 51.2$ to 51.7°. Since this angle exceeds the critical angle $\phi c$, the total reflection is thereby caused to occur, so that the alteration of advancing direction of the beam of light can be smoothly attained without any loss of energy of the incident light even in the absence of such measure as a deposition of aluminum on the reflection plane.

The light altered in the advancing direction as in the above is made incident on the lens section 27 which has an optimum hyperboloid of revolution. This lens section 27 is so designed as to render the focal length to be shorter than in the case of ordinary spherical lens, that is, the lens section 27 is made to have a shorter focal length as compared with the diameter, so as to improve the light receiving efficiency by rendering f-number to be smaller. When the face configuration is made elliptic, for example, to have a minor axis of 6 mm and a major axis of 8 mm, the focal length can be made to be 5 mm so that a light receiving lens of a small aberration can be obtained. Consequently, it is made possible to attain a high light receiving efficiency even when the light receiving element is made so small as to be, for example, about 0.8 mm upon being incorporated into the integrated circuit.

Figure 3:
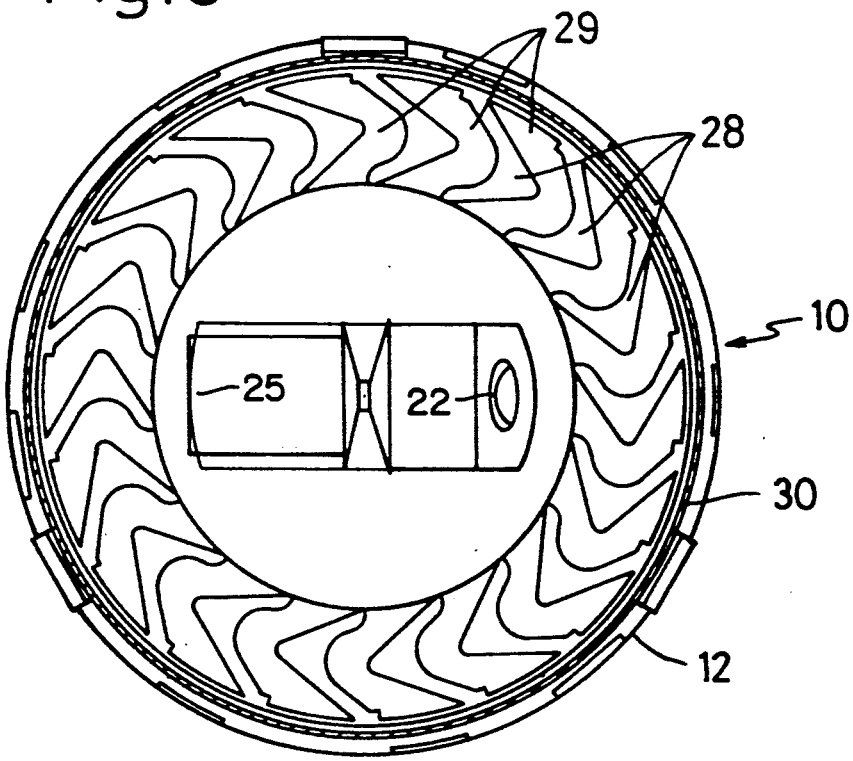
FIG. 3 is a bottom plan view with a bottom cover removed of the smoke detector in FIG. 1 for showing its interior.

The labyrinth member 12 mounted to the open bottom side of the body 11 includes many partitions 28 substantially L-shaped in section and erected along the periphery of the labyrinth member 12 to be mutually closer, as shown in FIG. 3, so as to define between them many smoke intrusion pathes 29 also substantially L-shaped in section. Here, the smoke intrusion pathes 29 communicate on their radially inner side with the smoke supervisory zone 15 while their radially outer side is properly opened at outer periphery of the labyrinth member 12 in any known manner. In this arrangement, the partitions 28 L-shaped in section are effective to prevent any external light from entering into the smoke supervisory zone 15 in their disposition, but are desirably colored black or dark enough for preventing any reflection of light from occurring unexpectedly on their surfaces. Further, it should be most desirable to provide an insect preventing net 30 along the periphery of the labyrinth member 12 for prevention of any intrusion of insects.

Now, in the photoelectric smoke detector according to the present invention, an intrusion of smoke from the smoke intrusion pathes 29 of the labyrinth member 12 into the smoke supervisory zone 15, causes, with the smoke forming particles, the light from the light projecting element 22 of the circuit substrate 17 and facing the smoke supervisory zone 15 through the optical-system base 14 to be scattered in the zone, and this scattered light is made incident on the prism section 26 of the light receiving lens 25. This incident light is refracted at the prism section 26 to be incident on the lens section 27, which renders the light to be condensed on the light receiving element incorporated in the integrated circuit 18 which is disposed at a relatively short focal length from the lens 25. An output of the light receiving element is provided to the smoke detecting circuit incorporated in the integrated circuit 18 and restricting the external noise influence, and the presence of smoke is thereby sensed. In this case, the incident of the condensed light from the lens section 27 of the lens 25 onto the light receiving element in the integrated circuit 18 can be carried out through the short focal length of the lens section 27 at a high light receiving efficiency with respect to the light receiving element which is made extremely small in the surface area, the required parts number can be reduced, the manufacturing costs can be reduced, and the dimensional minimization can be sufficienly realized. Further, as will be readily appreciated, the use of the light receiving lens 25 which alters the advancing direction of incident light allows such circuit substrate that can be positioned in a single plane to be utilized, so as to render the mounting of circuit parts to be easier and, also in this respect, the manufacturing costs can be attempted to be reduced.

In the photoelectric smoke detector according to the present invention, further, there may be adopted various design modifications. While, in particular, the light receiving element also has been disclosed in the foregoing embodiment to be incorporated in the integrated circuit 18, the arrangement may be so modified that the light receiving element is prepared separate from the integrated circuit and small in size and is positioned at focal point of the lens section 27 of the light receiving lens 25, and the integrated circuit 18 is formed to incorporate therein the smoke detecting circuit, driving circuit for the light projecting element and power source circuit and is connected to the small or, preferably, minute light receiving element.

What is claimed is:

1. A photoelectric scattered light smoke detector comprising a housing;

an optical-system base disposed in said housing and defining therein a smoke supervisory zone and a circuit accommodating zone;

a circuit substrate disposed in said circuit accommodating zone and provided concurrently with a light projecting element for projecting a beam of light into said smoke supervisory zone, a light receiving element for detecting scattered light of said beam of light from said light projecting element due to smoke particles, and a smoke detecting means for detecting the presence of smoke in response to an output from said light receiving element, said circuit substrate being coupled to said optical-system base; and a light receiving lens means held by said optical-system base and integrally formed to have a prism section having a reflection plane for altering advancing direction of said scattered light from said smoke supervisory zone and a lens section for condensing said direction-altered light from said prism section onto said light receiving element of the circuit substrate, said lens section being formed to have a hyperboloid of revolution providing a shorter focal length and a smaller f-number.

2. A detector according to claim 1, wherein said reflection plane in said prism section of said light receiving lens means is provided as a total reflection plane wherein an incident angle of said scattered light onto the reflection plane exceeds a critical angle of the plane determined by the index of refraction of the prism.

* * * * *